US011059632B2

(12) United States Patent
Bastero López

(10) Patent No.: US 11,059,632 B2
(45) Date of Patent: Jul. 13, 2021

(54) SELF-CLOSING DEVICE

(71) Applicant: Jesús María Bastero López, Plentzia (ES)

(72) Inventor: Jesús María Bastero López, Plentzia (ES)

( * ) Notice: Subject to any disclaimer, the term of this patent is extended or adjusted under 35 U.S.C. 154(b) by 0 days.

(21) Appl. No.: 16/620,509

(22) PCT Filed: Jun. 11, 2018

(86) PCT No.: PCT/ES2018/000053
§ 371 (c)(1),
(2) Date: Dec. 8, 2019

(87) PCT Pub. No.: WO2018/229313
PCT Pub. Date: Dec. 20, 2018

(65) Prior Publication Data

US 2020/0198852 A1 Jun. 25, 2020

(30) Foreign Application Priority Data

Jun. 14, 2017 (ES) ..... P201700637

(51) Int. Cl.
*B65D 47/08* (2006.01)
*B65D 25/46* (2006.01)
*B65D 47/20* (2006.01)

(52) U.S. Cl.
CPC ..... *B65D 47/0823* (2013.01); *B65D 25/46* (2013.01); *B65D 47/2018* (2013.01)

(58) Field of Classification Search
CPC . B65D 25/46; B65D 47/0823; B65D 47/2018
USPC ..... 222/546
See application file for complete search history.

(56) References Cited

U.S. PATENT DOCUMENTS

| | | | |
|---|---|---|---|
| 1,472,845 | A | 6/1923 | Kelly |
| 1,881,488 | A | 10/1932 | Gleason |
| 2,071,412 | A | 2/1937 | Lateur |
| 2,071,413 | A | 2/1937 | Lateur |

FOREIGN PATENT DOCUMENTS

EP 0287969 A2 10/1988

OTHER PUBLICATIONS

ISR; Spanish Patent Office; Madrid, Spainl Oct. 29, 2018.

*Primary Examiner* — Vishal Pancholi
(74) *Attorney, Agent, or Firm* — Patshegen IP LLC; Moshe Pinchas

(57) ABSTRACT

A device (1) incorporated into in plastic material closure (7) for containers (4) featured by its novel arrangement. It consists of parallel vertical walls, preferably of square, rectangular section, or of another shape, with a tilting lid (3) inside. That lid, when at rest position (6), leans against the opposite vertical wall to determine the closing of the hole thanks to the symmetry between the walls and moves to an open position (8) when exerting pressure on the walls of the container (4). The closing position (6) is achieved when the pressure on the container stops.

3 Claims, 1 Drawing Sheet

SELF-CLOSING DEVICE

BACKGROUND OF THE INVENTION

Currently, flexible containers are used to package some semisolid products, such as ketchup, mayonnaise, mustard, bath gels, creams, sauces, honey, condensed milk and others. Those flexible containers enable to dose these products with the pressure exerted on their walls. With a view to improving and to getting rid of the waste this kind of dosage produces around the cap when pressure stops taking place on the walls of the container, today's cap manufacturers have included some different kinds of dosing valves in the cap orifices, depending on the product features.

Examples of the existing dosing valves can be found at:

U.S. Pat. No. 10,074, on behalf of Coca-Cola Co. and Aptar Group. Inc.

EP Patent 2212956, on behalf of Weener Plastik GmbH

EP Patent 21822595, on behalf of Georg Menshen GmbH

EP Patent 2145484, on behalf of Zeller Plastik GbmH

EP Patent 2395383, on behalf of Plasticum Group, B.V.

All the valves therein described have the common feature of being separate parts of the closure, which involves costly manufacturing on account of the raw material used and their necessary assembly on supplementary frames first and then in the closure orifice itself.

It is therefore necessary and desirable to promote and develop alternatives to reduce or dispose of these hindrances, such is the case provided by this invention. This will eventually reduce considerably their cost despite maintaining their efficiency.

SUMMARY OF THE INVENTION

This device means to solve and simplify one or several of the drawbacks stated next by means of a special orifice and a tilting lid, whose axis is to be found at the button of it. These drawbacks are specifically linked to the valves inserted into orifices of plastic sealing caps for flexible or rigid or flexible containers.

The said simplification is based on a specific geometry of the closing orifice which belongs to it and is enhanced with a tilting lid with a complementary geometry inside it. Its geometry consists in vertical walls, preferably parallel to one another, making up a square section form or any other geometric figure, within which the said tilting lid rests. The former leans on the upper part of the opposite wall with its side edges fitted to the two vertical walls, thus ensuring the closure of the orifice when at rest. As for flexible containers, the dosing function—from the cap rest position—takes place when the right pressure is exerted on the container walls as the cap describes a circle outward the orifice, letting the contained product flow out; the above pressure is noticeably helped by the hindrance the said cap geometry plays on the air flow, with full collaboration of the orifice walls it slides on. The cleaning of the dosed-product waste happens immediately after having stopped pressing the container walls and replacing the cap to the rest and closing position. This movement is enabled by the memory of the plastic used throughout the manufacturing process and the suction made by the container when stopping pressing it as its sides rub the said orifice walls and let the potential waste slide inside. This application for an Invention Patent, as set out in the heading of the Descriptive Report, refers to a special device for plastic caps to be used on either flexible or rigid containers, which usually use dosing valves as required by the product contained in, preferably in the case of flexible containers.

In the case of flexible containers, this special device for caps relates to its exclusive geometry which, with the help of a tilting lid inside the cap, embodies a simple, competitive alternative to the dosing and waste-cleaning functions provided by the current valves built in closing orifices for flexible containers. This orifice also runs on the effect of the pressure and depression applied on the flexible container walls. At rest, the tilting lid is compulsorily kept inclined and resting on the upper part of the vertical wall opposite to enable the closing of the orifice. When it is opened, it describes a minimum turn as the flexible container is pressed from the outside onto the product, and then goes back to its rest position when stopping the pressure on the container. This action cleans the potential waste that may have been left at the front and the sides of the orifice. This operation occurs thanks to the special geometry between its walls and the supplementary sides of the tilting lid in every semicircular turn—with the pressure and depression movements on the container walls.

This new arrangement of the orifice meant to be patented now is manufactured in one single piece with an adapting closure which guarantees the same dosing and flux-cutting functions. Nonetheless, the procedure is simpler and more competitive than the ones provided today by valves in the two-piece caps used to this purpose in flexible containers. Our original proposal replaces the current valves.

BRIEF DESCRIPTION OF THE DRAWINGS

Next appears a description of the devices that make up the invention, only for example purposes and relating to the attached drawings where.

DETAILED DESCRIPTION OF THE INVENTION

Figure 1:
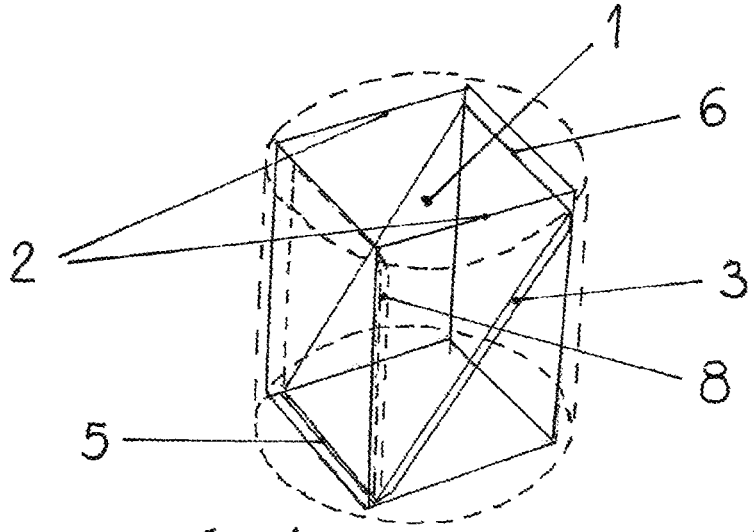
FIG. 1 shows a spatial view of the device.

FIG. 1 represents the device (1) subject matter of the invention, which perfectly fits to the neck of flexible containers to dispense the suitable products for them; device (1) which has a tilting lid (3) with the turn radius placed beneath (5) the orifice and, as it is initially arranged in a resting position, it leans on the upper part (6) of the opposite vertical wall, enabling the closing of the orifice; on pressing the walls of the container (4), it will move by turning upwards (11) to an open position (8).

Figure 2:
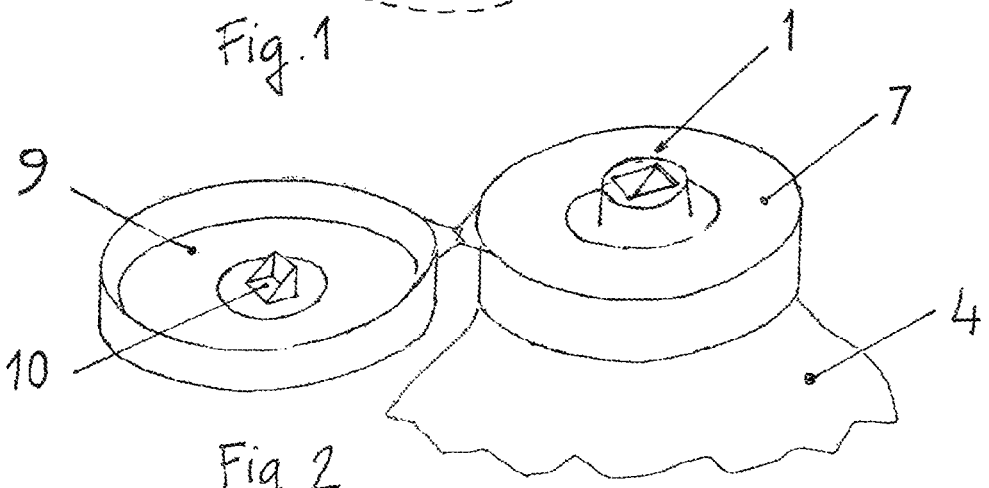
FIG. 2 shows a closure, in line with the invention parameters.

FIG. 2 shows the making of a so-called a hinge closure, usually applied to the kind of containers that demand dispensing and flow shut-off functions; it accounts for the most appropriate location of the device (1) within the shut-off body (7) adapted to a container (4); and also the very lid of the hinge (9) of the said closure (7), comprising the appendix (10) that will reinforce its complete closure at rest position.

This specific arrangement of the orifice and of the tilting lid (3) enables the tilting lid (3) to open (8), both on exerting and stopping exerting pressure on the walls of the flexible container (4). This movement ensures the correct dispense of the held product and the shutting-off as the turn guarantees the cleaning of the remaining waste on the parallel walls (2) subject matter of the invention.

Figure 3:
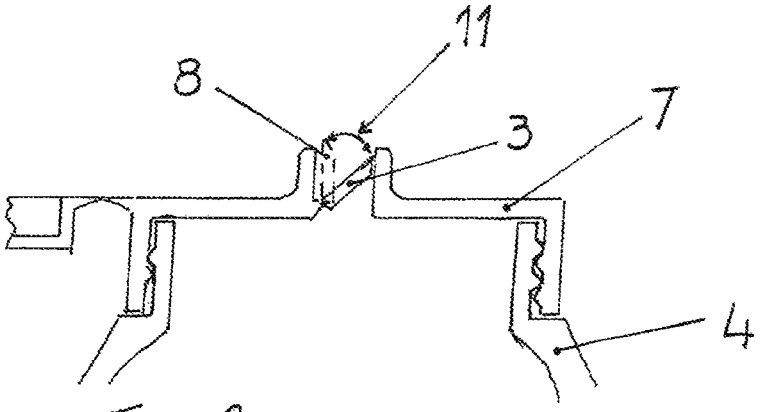
FIG. 3 is a vertical plane cross-section view of the device arrangement for closures, in line with the invention parameters.

FIG. 3 represents a section of the same device (1) subject matter of the invention which makes up a hinge closure (7) with the same features described in FIG. 1.

Details, shapes, sizes and the materials used to manufacture the orifice may be properly replaced by others; and may not depart from the essential content of the invention or from the scope defined by the claims stated next.

The invention claimed is:

1. Self-closing device for closures in plastic material applied to a container having flexible walls, which makes up a single piece with the closure, the device comprising:

an orifice having four vertical, parallel walls defining a square cross-section and a path extending between a bottom end of said vertical walls and a top end of said vertical walls;

a tilting lid coupled to said bottom end of a first wall of the four vertical walls and having rotation axis at said bottom end and being rotatable between a close position in which the tilting lid rests on an opposite vertical wall closing thereby the orifice and an open position in which the tilting lid is rotated to rest in parallel with said first wall and opening thereby the path;

wherein displacement of said tilting lid between said close position and open position is carried out by pressure exerted on the flexible walls of the container.

2. Self-closing device according to claim 1 wherein said pressure on the flexible walls of the container tilts the lid to an upright position, allowing simultaneously to perform the shut-off function with the immediate return of the tilting lid to its initial closing position when the flexible walls of the container are not pressed.

3. A self-closing device according to claim 1 further comprising a hinge-closure having an appendix, said appendix includes a shape complementary to the vertical walls of the orifice and the tilting lid when in the closed position thereof sealing thereby the orifice.

* * * * *